US010441991B2

(12) United States Patent
Ikeda et al.

(10) Patent No.: US 10,441,991 B2
(45) Date of Patent: Oct. 15, 2019

(54) METHOD OF MANUFACTURING CYLINDRICAL CONTAINER

(71) Applicant: Toyo Kohan Co., Ltd., Tokyo (JP)

(72) Inventors: Yasuyuki Ikeda, Kudamatsu (JP); Shinichi Taya, Kudamatsu (JP); Kota Sadaki, Kudamatsu (JP)

(73) Assignee: TOYO KOHAN CO., LTD, Tokyo (JP)

( * ) Notice: Subject to any disclaimer, the term of this patent is extended or adjusted under 35 U.S.C. 154(b) by 0 days.

(21) Appl. No.: 14/429,635

(22) PCT Filed: Aug. 28, 2013

(86) PCT No.: PCT/JP2013/072955
§ 371 (c)(1),
(2) Date: Mar. 19, 2015

(87) PCT Pub. No.: WO2014/057737
PCT Pub. Date: Apr. 17, 2014

(65) Prior Publication Data

US 2015/0246384 A1 Sep. 3, 2015

(30) Foreign Application Priority Data

Oct. 10, 2012 (JP) ..... 2012-224747

(51) Int. Cl.
*B21D 51/26* (2006.01)
*B21D 22/22* (2006.01)
*B21D 24/04* (2006.01)

(52) U.S. Cl.
CPC ..... *B21D 51/26* (2013.01); *B21D 22/22* (2013.01); *B21D 24/04* (2013.01)

(58) Field of Classification Search
CPC ..... B21D 51/26; B21D 24/04; B21D 22/02; B21D 22/22; B21D 24/06; B21D 24/08;
(Continued)

(56) References Cited

U.S. PATENT DOCUMENTS 3,263,637 A * 8/1966 Cox ..... B21D 22/26 72/343
3,664,172 A * 5/1972 Cvacho ..... B21D 24/04 72/350
(Continued)

FOREIGN PATENT DOCUMENTS

CN 101147940 A 3/2008
CN 102672062 A 9/2012
(Continued)

OTHER PUBLICATIONS

Murakami, translation of JP07088569A, pp. 1-3, translated on Jan. 14, 2019. (Year: 2019).*
(Continued)

*Primary Examiner* — Teresa M Ekiert
(74) *Attorney, Agent, or Firm* — Muncy, Geissler, Olds & Lowe, P.C.

(57) ABSTRACT

There is provided a method of manufacturing a cylindrical container using a metal sheet on at least one surface of which the metal is exposed. The method includes: obtaining a blank having a hexagonal shape from the metal sheet; and processing the blank into a cylindrical shape by pressing a central part of the blank with a punch in a state in which a peripheral part of the blank is clamped between a die for drawing process and a blank holder. The method is characterized by the following features. At least one of the die for drawing process and the blank holder has a groove-formed area at a portion of a surface thereof. The portion corresponds to a side of the blank. The groove-formed area is formed with a plurality of grooves along the circumferential direction. The blank is processed into the cylindrical shape by clamping the peripheral part of the blank between the die for drawing process and the blank holder so that the surface of the blank on which the metal is exposed is in a state of
(Continued)

facing the groove-formed area and the side of the blank is in a position that corresponds to the groove-formed area.

4 Claims, 12 Drawing Sheets

(58) Field of Classification Search
CPC ..... B21D 24/10; B21D 24/12; B21D 22/28; B21D 22/20
See application file for complete search history.

(56) References Cited

U.S. PATENT DOCUMENTS

| | | | | | |
|---|---|---|---|---|---|
| 3,789,649 | A * | 2/1974 | Clowes | B21D 22/22 | 413/69 |
| 4,587,827 | A * | 5/1986 | Wessels | B21D 22/26 | 72/348 |
| 5,630,337 | A * | 5/1997 | Werth | B21D 22/28 | 72/349 |
| 5,749,258 | A * | 5/1998 | Werth | B21D 22/28 | 72/347 |
| 5,901,599 | A * | 5/1999 | Sato | B21D 24/04 | 72/350 |
| 9,149,854 | B2 * | 10/2015 | Zhou | B21D 22/22 | |
| 2008/0184764 | A1 * | 8/2008 | Nakamura | B21D 25/04 | 72/350 |
| 2012/0279272 | A1 * | 11/2012 | Zhou | B21D 22/22 | 72/350 |

FOREIGN PATENT DOCUMENTS

| | | | | |
|---|---|---|---|---|
| JP | 63-112029 | A | | 5/1988 |
| JP | 2-112830 | A | | 4/1990 |
| JP | 02205208 | A | * | 8/1990 |
| JP | 07088569 | A | * | 4/1995 |
| JP | 7-44678 | U | | 11/1995 |
| WO | WO 98/51426 | A1 | | 11/1998 |
| WO | WO 99/48631 | A1 | | 9/1999 |

OTHER PUBLICATIONS

Mori et al., translation of JP02205208A, pp. 1-3, translated on Jan. 14, 2019. (Year: 2019).*

An Extended European Search Report from the corresponding European application EP 13846176, dated May 9, 2016, 5 pages.

Office Action dated Aug. 17, 2016 of corresponding CN patent application No. 201380051288.9 (15 pages).

A Japanese Decision of Refusal, with English language translation, of corresponding JP Patent Application No. 2012-224747 dated Dec. 20, 2016.

Office Action dated Mar. 14, 2017 in corresponding CN Application No. 201380051288.9, w/English-language translation, (10 pages).

Office Action dated Nov. 29, 2017 in CN Application No. 201380051288.9.

Korean official Action dated Mar. 18, 2019 in application No. 10-2015-7005068 and its English translation; pp. 1-7.

* cited by examiner

METHOD OF MANUFACTURING CYLINDRICAL CONTAINER

BACKGROUND OF THE INVENTION

1. Technical Field of the Invention

The present invention relates to a method of manufacturing a cylindrical container using a metal sheet on at least one surface of which the metal is exposed.

2. Description of the Related Art

When a metal sheet is drawn into a cylindrical shape, blanks punched out to circular sheets have heretofore been used. However, when blanks such as circular sheets are punched out of an elongate rolled metal sheet, even though the blanks to be punched out are arranged in a staggered manner so that an unnecessary portion between adjacent blanks is the least, a problem arises in that the unnecessary portion, which includes approximately triangular shapes, inevitably remains as a scrap portion to reduce the yield rate. In view of this, Patent Document 1 (PCT International Publication No. WO 98/51426) proposes a technique of punching out the blanks into a hexagonal shape in order to reduce the occurrence of such a scrap portion.

If the blanks are formed into a hexagonal shape, however, another problem may arise in that portions (earings) higher in container height than the other portions readily occur due to the effect of corner parts of the blank when the drawing process is performed, compared to the case of circular shape. In view of this, Patent Document 2 (PCT International Publication No. WO 99/48631) discloses a method in which, when the drawing process is performed using a hexagonally-shaped blank formed of a resin coated steel sheet having a resin layer, a die for drawing process is used which has groove-formed areas, each having a plurality of grooves, at certain portions of a wrinkle preventing surface, wherein the certain portions correspond to the corner parts of the hexagonal shape.

SUMMARY OF THE INVENTION

According to the technique disclosed in Patent Document 2, the occurrence of portions (earings) higher in container height than the other portions can be effectively suppressed when a resin coated steel sheet having a resin layer is used. However, the studies by the present inventors have revealed that the occurrence of portions (earings) higher in container height than the other portions cannot be suppressed when using a metal sheet on a surface of which the metal is exposed without a resin layer.

The present invention has been made in consideration of such actual circumstances, and an object of the present invention is to provide a method of manufacturing which, when manufacturing a cylindrical container using a metal sheet on at least one surface of which the metal is exposed, has a high productivity and can effectively suppress the occurrence of portions (earings) higher in container height than the other portions.

As a result of intensive studies to achieve the above object, the present inventors have found that, when a metal sheet on at least one surface of which the metal is exposed is used, the above object can be achieved by using a die for drawing process and/or a blank holder that have a groove-formed area at a portion of the surface thereof, when obtaining a hexagonally-shaped blank from the metal sheet and using the hexagonally-shaped blank to manufacture a cylindrical container. The portion of the surface corresponds to a side of the hexagonally-shaped blank. The groove-formed area is formed with a plurality of grooves along the circumferential direction. The inventors have thus accomplished the present invention.

That is, according to the present invention, there is provided a method of manufacturing a cylindrical container using a metal sheet on at least one surface of which the metal is exposed. The method comprises: obtaining a blank having a hexagonal shape from the metal sheet; and processing the blank into a cylindrical shape by pressing a central part of the blank with a punch in a state in which a peripheral part of the blank is clamped between a die for drawing process and a blank holder. The method is characterized by the following features. At least one of the die for drawing process and the blank holder has a groove-formed area at a portion of a surface thereof. The portion corresponds to a side of the blank. The groove-formed area is formed with a plurality of grooves along the circumferential direction. The blank is processed into the cylindrical shape by clamping the peripheral part of the blank between the die for drawing process and the blank holder so that the surface of the blank on which the metal is exposed is in a state of facing the groove-formed area and the side of the blank is in a position that corresponds to the groove-formed area.

In the method of manufacturing a cylindrical container according to the present invention, it is preferred that the groove-formed area on the surface of the at least one of the die for drawing process and the blank holder is formed to have a width of 15° to 45°.

According to the present invention, there can be provided a method of manufacturing which, when manufacturing a cylindrical container using a metal sheet on at least one surface of which the metal is exposed, has a high productivity and can effectively suppress the occurrence of portions (earings) higher in container height than the other portions.

DESCRIPTION OF THE PREFERRED EMBODIMENT

A method of manufacturing a cylindrical container according to the present embodiment will hereinafter be described with reference to the drawings.

<Obtaining Hexagonally-shaped Blanks>

Figure 1A:
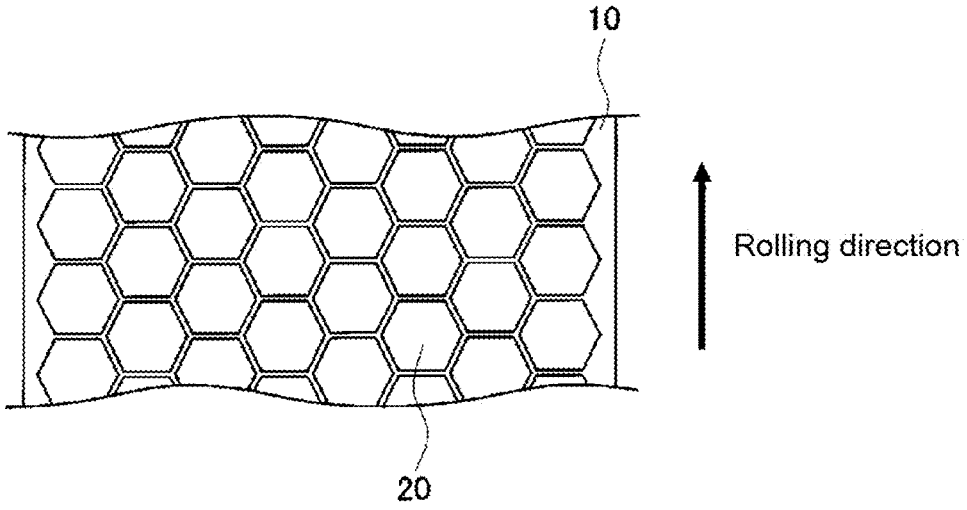
FIG. 1A is a schematic view when blanks 20 having a hexagonal shape are punched out of a metal sheet 10.

In the present embodiment, as shown in FIG. 1A, a plurality of hexagonally-shaped blanks 20 for forming cylindrical containers are obtained first by punching the blanks 20 out of a metal sheet 10 on at least one surface of which the metal is exposed (hereinafter, referred simply to as a "metal sheet 10"). FIG. 1A is a schematic view when the blanks 20 having a hexagonal shape are punched out of the metal sheet 10.

The metal sheet 10 may be, but is not particularly limited to, a sheet of metal that substantially does not have an organic resin layer and is configured such that the metal is exposed on at least one surface thereof. A sheet of metal on both surfaces of which the metal is exposed may preferably be used. Examples of such a sheet of metal on at least one surface of which the metal is exposed include metal sheets for the use in battery cases, metal sheets for the use in beverage containers, and metal sheets for the use in food containers. In the present embodiment, specific examples of the metal sheet 10 include, but are not particularly limited to, various kinds of metal sheets, such as steel sheet, tin-free steel sheet, tin plated steel sheet, aluminum alloy sheet, zinc plated steel sheet, zinc-cobalt-molybdenum composite plated steel sheet, zinc-nickel alloy plated steel sheet, zinc-iron alloy plated steel sheet, alloyed hot dip zinc plated steel sheet, zinc-aluminum alloy plated steel sheet, zinc-aluminum-magnesium alloy plated steel sheet, nickel plated steel sheet, copper plated steel sheet, and stainless steel sheet.

Figure 1B:
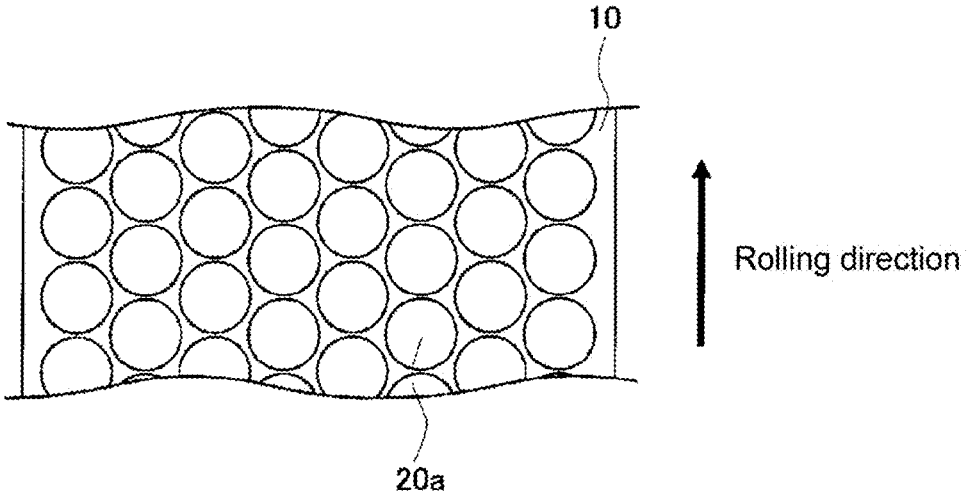
FIG. 1B is a schematic view when blanks 20*a* having a circular shape are punched out of a metal sheet 10.

According to the present embodiment, when the blanks for forming cylindrical containers are obtained from the metal sheet as illustrated in FIG. 1A, the blanks can be punched out into a hexagonal shape thereby to suppress an unnecessary portion between adjacent blanks, compared to the case in which blanks are punched out into a circular shape so that a plurality of circular blanks 20*a* are obtained as illustrated in FIG. 1B. This allows the improvement of the yield rate. In particular, when the blanks are punched out into a circular shape as illustrated in FIG. 1B, an unnecessary portion remains to include approximately triangular shapes having a relatively large surface area, whereas when the blanks are punched out into a hexagonal shape as illustrated in FIG. 1A, such an unnecessary portion does not remain, so that the utilization efficiency of the metal sheet 10 can be effectively enhanced thereby to improve the yield rate.

Figure 2:
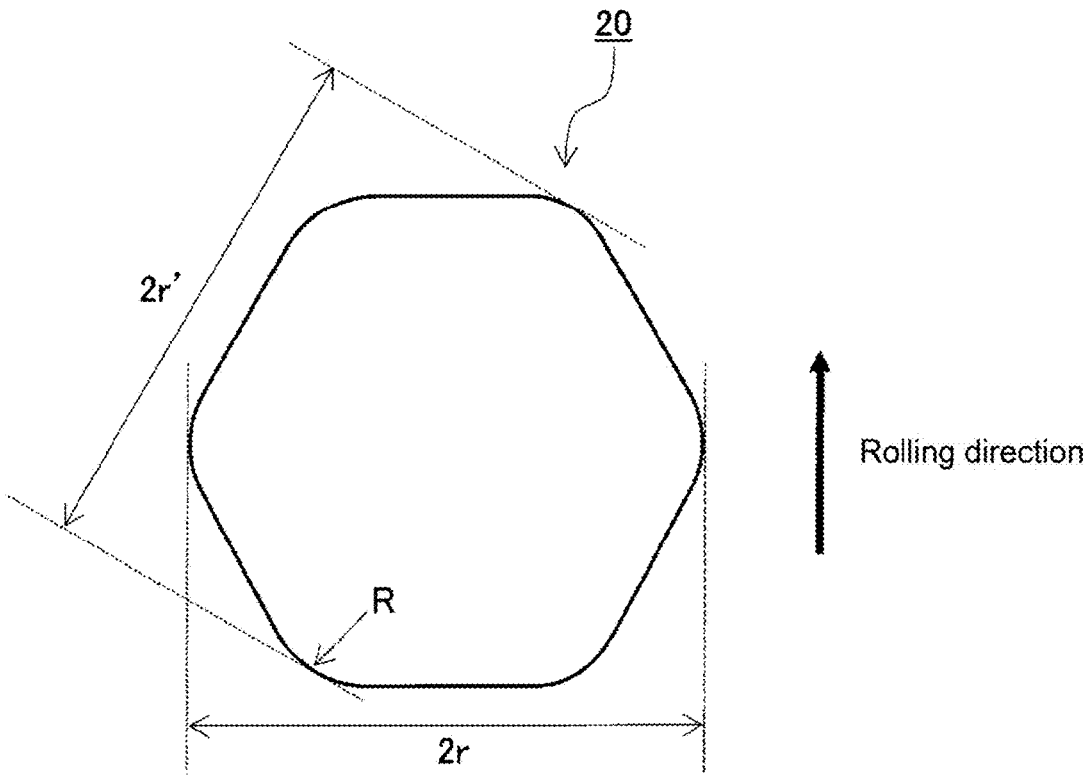
FIG. 2 is a schematic plan view illustrating the shape of a hexagonally-shaped blank 20 obtained according to the present embodiment.

FIG. 2 is a schematic plan view illustrating the shape of the hexagonally-shaped blank 20 obtained according to the present embodiment. As illustrated in FIG. 2, the blank 20 is based on a hexagonal shape. It is preferred that each corner part of the hexagonally-shaped blank 20 has a shape rounded into a circular arc. Such a shape rounded into a circular arc can effectively prevent the occurrence of height variation due to the corner parts (in particular due to the corner parts being in a sharply-angled shape) when the blank is formed into a cylindrical container. The shapes rounded into a circular arc and formed at corner parts of the hexagonally-shaped blank 20 have a radius of curvature R. The radius of curvature R and a diagonal line length $2r$ ($2r'$) may be appropriately set depending on the size of products to be obtained. The ratio $R/2r$ and the ratio $R/2r'$ may preferably be within a range of 0.15 to 0.45, and more preferably within a range of 0.25 to 0.40. If the ratio falls below the range, the shape of the blank will be unduly close to a circular shape to reduce the yield rate, whereas if the ratio falls above the range, the height variation in the formed can will be large due to the effect of the corner parts.

The embodiment illustrated in FIG. 1A and FIG. 2 exemplifies an aspect in which the hexagonally-shaped blanks 20 are punched out so that a pair of sides among the sides that constitute the hexagonal shape of each blank 20 is perpendicular to the rolling direction of the metal sheet 10, but the present invention is not particularly limited to this aspect. In another aspect, for example, the blanks may be punched out so that a pair of sides is parallel to the rolling direction.

Moreover, the embodiment illustrated in FIG. 1A and FIG. 2 exemplifies a case in which the hexagonally-shaped blanks 20 have a shape based on a regular hexagonal shape, but the present invention is not particularly limited thereto. The blanks may have another hexagonal shape in consideration of anisotropy of the metal sheet 10 due to the rolling. More specifically, in FIG. 2, the blank may have a hexagonal shape in which the relationship between a length $2r$ of the diagonal line perpendicular to the rolling direction and a length $2r'$ of another diagonal line is $2r \neq 2r'$ (i.e., a hexagonal shape that is other than a regular hexagonal shape and has the same length of each pair of opposing sides).

<Drawing Process>

Subsequently, in the present embodiment, the hexagonally-shaped blank 20 obtained as the above is processed into a cylindrical shape through a drawing process.

Figure 3:
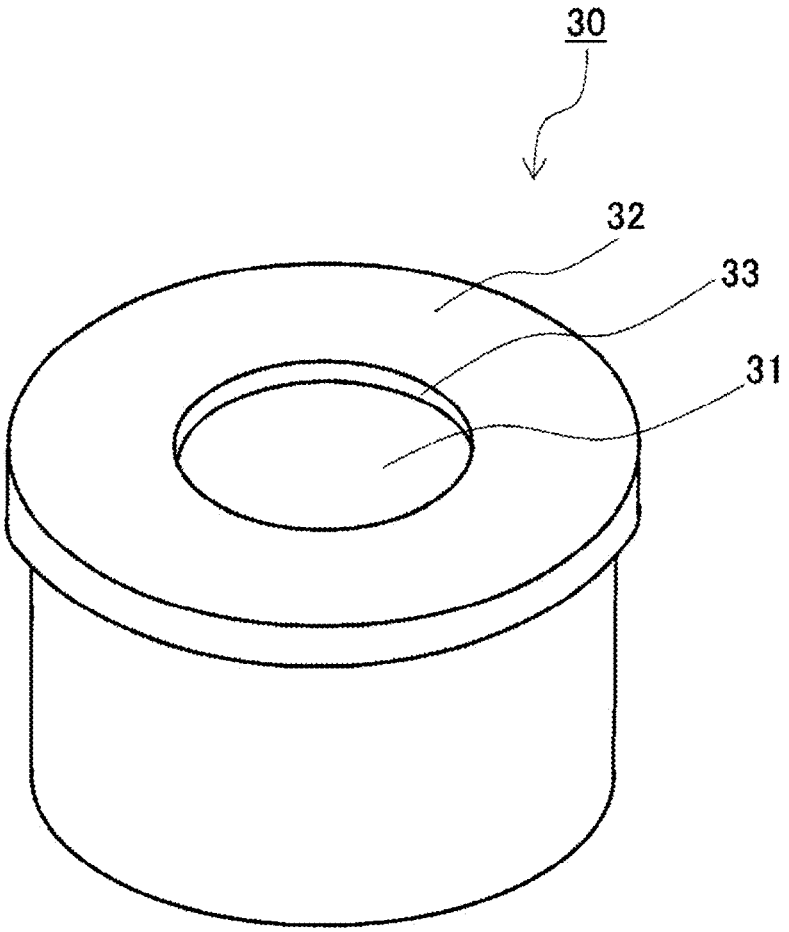
FIG. 3 is a schematic perspective view illustrating the structure of a die 30 for drawing process which is used in the present embodiment.

In the present embodiment, the drawing process for the hexagonally-shaped blank 20 is performed using a die 30 for drawing process as illustrated in FIG. 3. The die 30 has a circular opening part 31 and a wrinkle preventing surface 32. The die 30 further has a shoulder part 33 which merges from the wrinkle preventing surface 32 into the opening part 31 with a predetermined radius of curvature. Specific drawing process will be described with reference to FIG. 4. The hexagonally-shaped blank 20 is first placed on the wrinkle preventing surface 32 of the die 30 for drawing process so that the center of the blank 20 is aligned with the center of the die 30. A doughnut-shaped blank holder 40 is then caused to be in contact with the upper surface of the blank 20. The blank holder 40 has an aperture through which a punch 50 can pass. The peripheral part of the hexagonally-shaped blank 20 is clamped between the wrinkle preventing surface 32 of the die 30 and the blank holder 40. In this state, the punch 50 is moved downward in the arrow direction to perform the drawing process for the hexagonally-shaped blank 20.

The die 30 for drawing process is provided with the shoulder part 33 which merges from the wrinkle preventing surface 32 into the opening part 31 with a predetermined radius of curvature. This allows the hexagonally-shaped blank 20 to smoothly fit into the opening part 31 of the die 30. A load (wrinkle preventing load) is applied to the blank 20 via the blank holder 40 to suppress the occurrence of wrinkle. In such a manner, the hexagonally-shaped blank 20 is processed into a cylindrical shape by performing the drawing process, and a cylindrical container can be obtained.

Figure 5A:
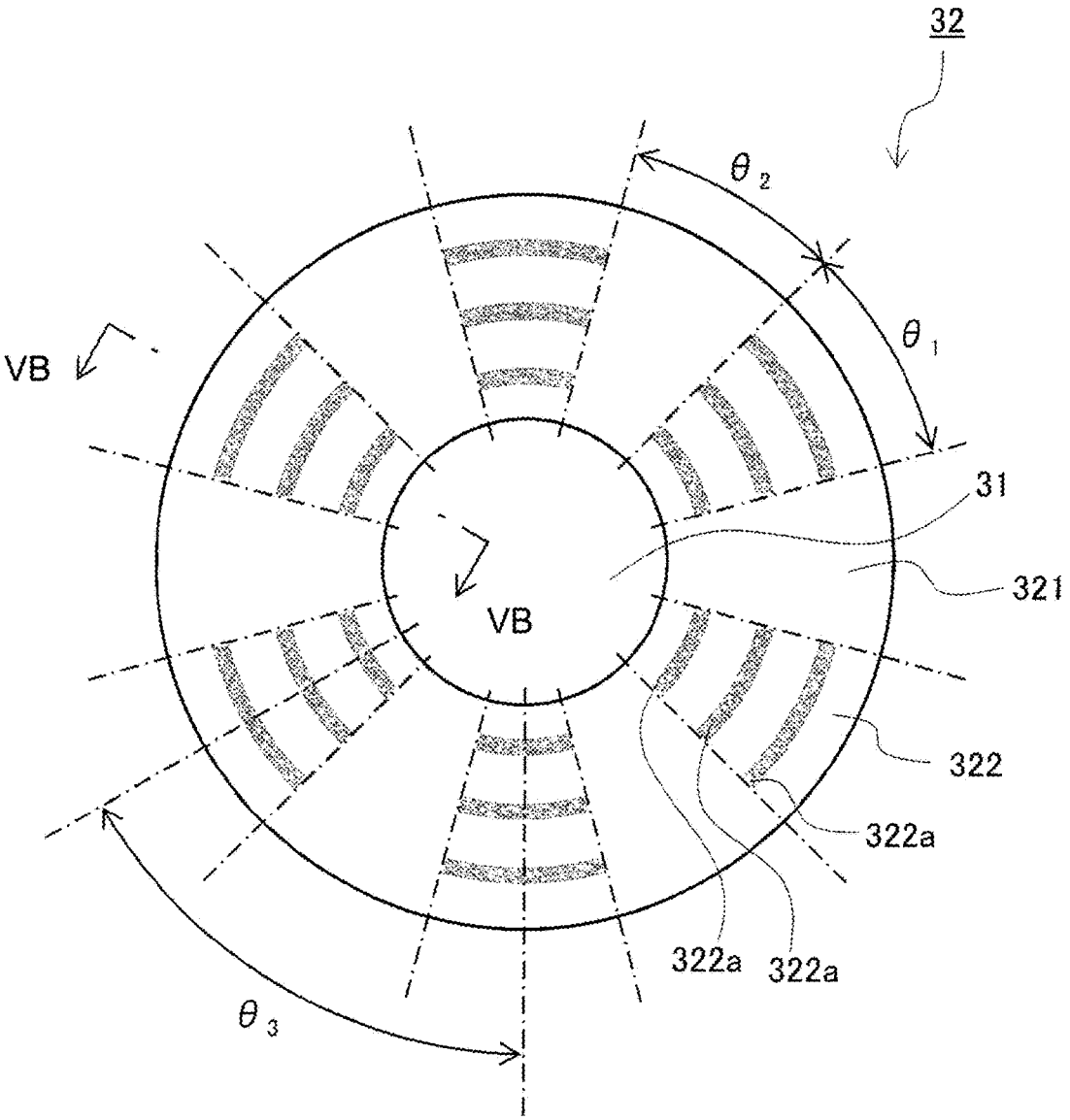
FIG. 5A is a schematic plan view illustrating a specific configuration of a wrinkle preventing surface 32 of the die 30 for drawing process which is used in the present embodiment.
Figure 5B:
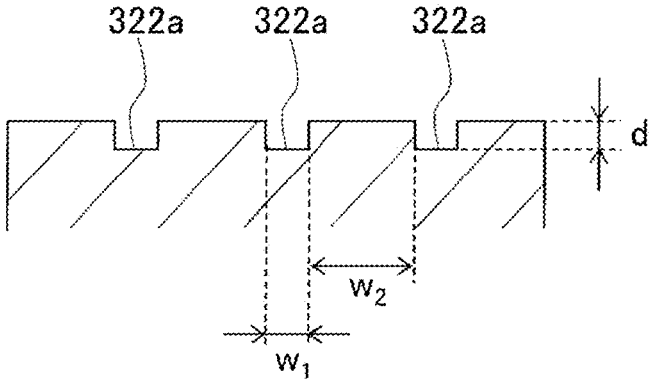
FIG. 5B is a cross-sectional view along line VB-VB in FIG. 5A.

In the present embodiment, as illustrated in FIG. 5A, the die 30 to be used has six groove-formed areas 322 on the wrinkle preventing surface 32. The groove-formed areas 322 are provided at positions that correspond to six sides of the hexagonally-shaped blank 20 to be drawn. Here, FIG. 5A is a schematic plan view illustrating a specific configuration of the wrinkle preventing surface 32 of the die 30 which is used in the present embodiment, while FIG. 5B is a cross-sectional view along line VB-VB in FIG. 5A. As illustrated in FIG. 5A and FIG. 5B, each groove-formed area 322 comprises a plurality of grooved parts (recessed parts) 322*a* that have a depth d and are formed along the circumferential direction of the wrinkle preventing surface 32. In the present embodiment, as illustrated in FIG. 5A, these groove-formed areas 322 are formed at positions that correspond to six sides of the hexagonally-shaped blank 20 to be drawn. That is, in the present embodiment, the groove-formed areas 322 are formed at regular intervals with an angle of $\theta_3$=60°.

Figure 4:
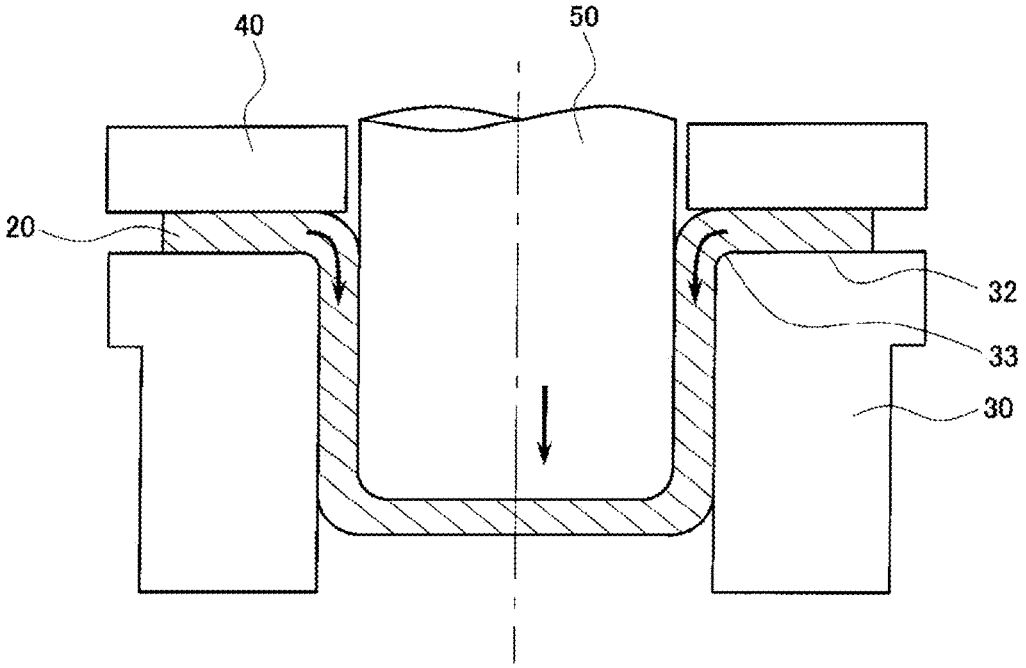
FIG. 4 is a schematic view illustrating a method of drawing process in the present embodiment.
Figure 6:
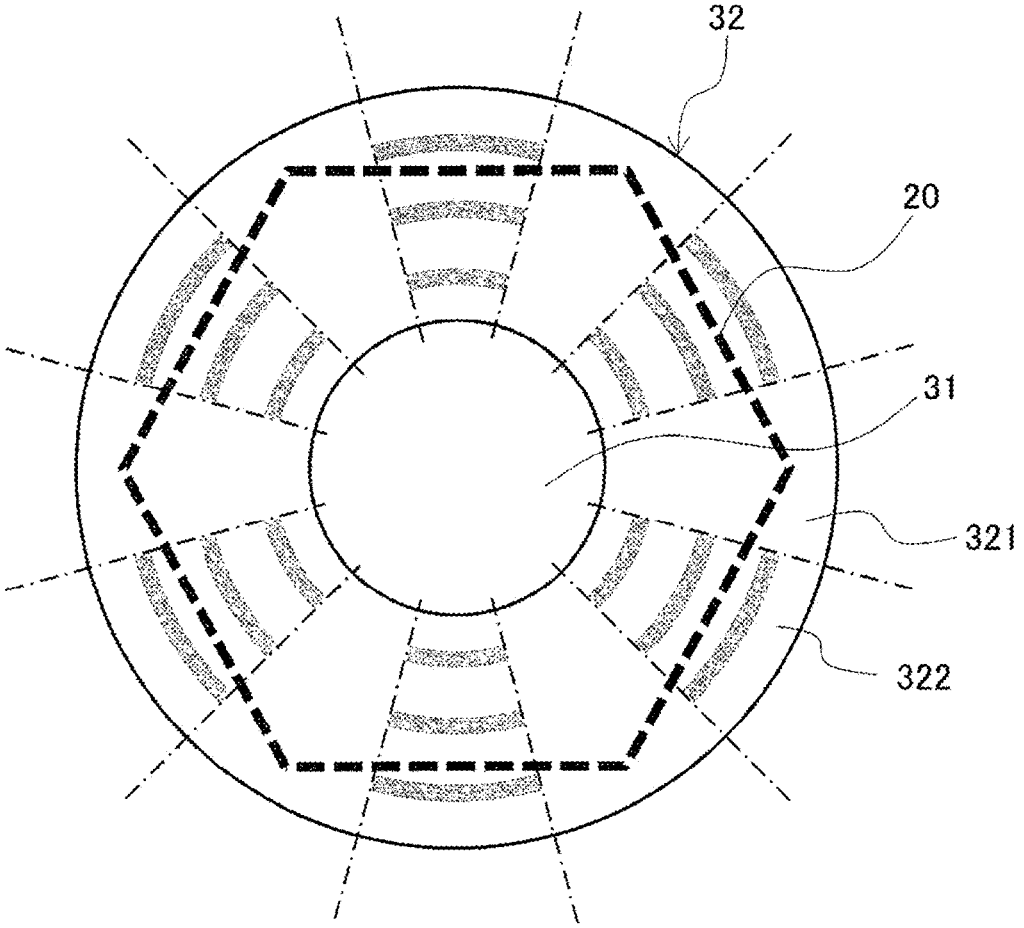
FIG. 6 is a view for explaining the positional relationship between the hexagonally-shaped blanks 20 and groove-formed areas 322.

In the present embodiment, when the drawing process for the hexagonally-shaped blank 20 is performed using the die 30, the blank holder 40 and the punch 50 as illustrated in FIG. 4, the drawing process is performed in a state as illustrated in FIG. 6 in which the blank 20 (indicated by dashed lines in the figure) is disposed on the wrinkle preventing surface 32 of the die 30 and the peripheral part of the blank 20 is clamped between the die 30 and the blank holder 40. More specifically, the hexagonally-shaped blank 20 is disposed on the wrinkle preventing surface 32 so that: the surface of the blank 20 on which the metal is exposed is directed to face the wrinkle preventing surface 32 of the die 30; positions of the six sides of the hexagonal shape of the blank 20 are located to correspond to the groove-formed areas 322; and positions of the six corner parts of the hexagonal shape are located to correspond to smooth areas 321 on which no grooved part is formed, and in this state the drawing process is performed.

According to the present embodiment, when the drawing process is performed to press the hexagonally-shaped blank 20 with the punch 50, the groove-formed areas 322 act to make slower a withdrawal speed $V_s$ of specific portions of the blank 20 than a withdrawal speed $V_c$ of the other portions. Here, when the blank 20 is withdrawn into the opening part 31, the withdrawal speed $V_s$ is defined as a speed of portions of the blank 20 which correspond to the sides of the blank 20, while the withdrawal speed $V_c$ is defined as a speed of portions which correspond to the corner parts in contact with the smooth areas 321. Thus, according to the present invention, the withdrawal speed $V_c$ into the opening part 31 of the portions of the hexagonally-shaped blank 20 corresponding to its corner parts can be relatively high thereby to effectively suppress the occurrence of portions (earings) higher in container height than the other portions, which would be caused by the corner parts.

In the present embodiment, the reasons for such an action occurring are not necessarily clear, but it appears that this is because the plurality of grooved parts (recessed parts) 322*a* formed in the groove-formed areas 322 act to bite into the exposed metal surface of the hexagonally-shaped blank 20 within specific areas formed with the grooved parts (recessed parts) 322*a* and this bite causes the relatively slow withdrawal speed $V_s$ into the opening part 31 of the portions of the blank 20 corresponding to its sides.

In contrast, when a hexagonally-shaped blank formed of a resin coated steel sheet having a resin layer is used as with the above-described Patent Document 2 (WO 99/48631), such a bite appears not to occur because the metal surface is not exposed. In this case, therefore, the groove-formed areas 322 can be considered to act as friction-reducing parts compared with the smooth areas 321.

The formation angle $\theta_1$ of the groove-formed areas 322 may preferably be within a range of 15° to 45°, and more preferably within a range of 20° to 40°, so that the withdrawal speed $V_s$ into the opening part 31 of the portions of the hexagonally-shaped blank 20 corresponding to its sides can be within an appropriate range in relation to the withdrawal speed $V_c$ into the opening part 31 of the portions corresponding to the corner parts. The formation angle $\theta_1$ of the six groove-formed areas 322 formed on the wrinkle preventing surface 32 may be all the same or may not be the same. However, from an aspect that the occurrence of portions (earings) higher in container height than the other portions can be more appropriately suppressed in a cylindrical container to be obtained, the formation angle $\theta_1$ of all the six groove-formed areas 322 is preferably the same. The formation angle $\theta_2$ of the smooth areas 321 may be set depending on the formation angle $\theta_1$ of the groove-formed areas 322.

In the embodiment illustrated in FIG. 5A and FIG. 5B, the number of the grooved parts 322*a* that form each of the groove-formed areas 322 is three, but the number of the grooved parts 322*a* is not particularly limited, and may be set so that the withdrawal speed $V_s$ into the opening part 31 of the portions of the hexagonally-shaped blank 20 corresponding to its sides can be within an appropriate range in relation to the withdrawal speed $V_c$ into the opening part 31 of the portions corresponding to the corner parts. The width $w_1$ of the grooved parts 322*a* is not particularly limited, but may preferably be 1 to 5 mm. The width $w_2$ between adjacent grooved parts 322*a* is also not particularly limited, but may preferably be 1 to 5 mm. The width $w_1$ of the grooved parts 322*a* may be the same or may not be the same. The width $w_2$ between adjacent grooved parts 322*a* may be the same or may not be the same. The depth d of the grooved parts 322*a* is not particularly limited, and may be a depth determined such that the grooved parts 322*a* can bite into the exposed metal surface of the blank 20, which may preferably be 0.1 to 1 mm.

In the present embodiment, when the drawing process is performed for the hexagonally-shaped blank 20, the die 30 for drawing process and the blank holder 40 apply a certain clamping force to the blank 20. The clamping force may be appropriately set depending on the size and/or the material strength of the blank 20, and is not particularly limited.

Embodiments of the present invention have heretofore been explained. These embodiments are described to facilitate understanding of the present invention and are not described to limit the present invention. It is therefore intended that the elements disclosed in the above embodiments include all design changes and equivalents to fall within the technical scope of the present invention.

For example, the above-described embodiments exemplify a configuration in which the groove-formed areas 322 are provided on the wrinkle preventing surface 32 of the die 30 for drawing process, but an alternative embodiment may employ a configuration in which the groove-formed areas 322 are provided on the surface of the blank holder 40 that is to be in contact with the hexagonally-shaped blank 20. In a further embodiment, both of the wrinkle preventing surface 32 of the die 30 and the blank holder 40 may be configured to be provided with the groove-formed areas 322.

Moreover, the above-described embodiments exemplify a configuration in which each of the groove-formed areas 322 comprises a plurality of grooved parts 322*a*, but a plurality of grooved parts 322*a* may not necessarily be required, and a single grooved part may be included in each of the groove-formed areas 322. In particular, even when each of the groove-formed areas 322 is configured to have only a single grooved part 322*a* in such a manner, the groove-formed areas 322 can each bite into the exposed metal surface of the hexagonally-shaped blank 20 within an area formed with the single grooved part 322*a*, so that the withdrawal speed $V_s$ into the opening part 31 of the portions of the blank 20 corresponding to its sides can be relatively slow thereby to effectively suppress the occurrence of portions (earings) higher in container height than the other portions, which would be caused by the corner parts. If, however, each of the groove-formed areas 322 comprises a plurality of grooved parts 322*a*, the stress applied to the hexagonally-shaped blank 20 can be distributed. It is therefore preferred that the groove-formed areas 322 each comprise a plurality of grooved parts 322*a* depending on the material, shape and the like of the hexagonally-shaped blank 20.

Furthermore, in the above-described embodiments, the grooved parts 322*a* have shapes along the circumferential direction, but the present invention is not limited to such shapes. Any shape can be employed for the grooved parts 322*a* if they are in a recessed shape or recessed shapes that can allow the grooved parts 322*a* to bite into the exposed metal surface of the hexagonally-shaped blank 20.

EXAMPLES

The present invention will hereinafter be described specifically with reference to examples, but the present invention is not limited to these examples.

Example 1

A nickel plated low-carbon steel sheet having a sheet thickness of 0.25 mm with no resin layer was first prepared as the metal sheet 10. Hexagonally-shaped blanks as illustrated in FIG. 2 were punched out of the prepared nickel plated low-carbon steel sheet. In the present example, hexagonally-shaped Blank Samples 1 to 4 were prepared to have a diagonal line length of 2*r*=57 mm and different radii of curvature R as below, each curvature having a shape rounded into a circular arc and formed at a corner part.

Sample 1: 2*r*=57 mm, R=24.5 mm

Sample 2: 2*r*=57 mm, R=22.0 mm

Sample 3: 2*r*=57 mm, R=19.5 mm

Sample 4: 2*r*=57 mm, R=17.0 mm

The die 30 for drawing process, the blank holder 40 and the punch 50 as illustrated in FIGS. 3 to 5 were used for the drawing process. The drawing process was performed using the obtained Blank Samples 1 to 4 in a state in which each blank sample was clamped between the die 30 and the blank holder 40 so that the sides of the hexagonal shape of the blank sample would be located to correspond to the groove-formed areas 322 of the die 30 (i.e., in a state as illustrated in FIG. 6), and cylindrical containers having a container height of about 18 mm were thus manufactured. In the present example, a die having the structure below was used as the die 30 for drawing process.

Outer diameter of wrinkle preventing surface 32: φ57 mm

Inner diameter of wrinkle preventing surface 32: φ32 mm

Angle $\theta_1$ of groove-formed areas 322 of wrinkle preventing surface 32: 30°

Angle $\theta_2$ of smooth areas 321 of wrinkle preventing surface 32: 30°

Angle $\theta_3$ between groove-formed areas 322: 60°

Number of grooved parts 322*a* in each groove-formed area 322: 4

Width $w_1$ of grooved parts 322*a:* 1.5 mm

Width $w_2$ between adjacent grooved parts 322*a:* 1.5 mm

Depth d of grooved parts 322*a:* 0.3 mm

A blank holder having the same outer diameter and inner diameter as those of the wrinkle preventing surface 32 of the die 30 was used as the blank holder 40, a punch having a punch diameter: φ31.4 mm was used as the punch 50, and the clamping force applied by the die 30 and the blank holder 40 was set to 20 kN.

With regard to 12 locations in the circumferential direction of each of the obtained cylindrical containers, the container height and the sidewall thickness at a height position of 13 mm from the container bottom were measured, and a height variation ΔH (ΔH=(maximum value of container height)−(minimum value of container height)) and a thickness variation Δt (Δt=(maximum value of sidewall thickness)−(minimum value of sidewall thickness)) were calculated. Results of the height variation ΔH are illustrated in FIG. 7, and results of the thickness variation Δt are illustrated in FIG. 8.

In addition, for comparison in this example, a different drawing process was performed for Blank Samples 1 to 4 using a die without the groove-formed areas 322 as the die 30 for drawing process, and a further different process was also performed for Blank Samples 1 to 4 in a state in which each blank sample was clamped between the die 30 and the blank holder 40 so that the corner parts of the hexagonal shape of the blank sample would be located to correspond to the groove-formed areas 322 (i.e., in a state of the hexagonally-shaped blank rotated by 30° from the state as illustrated in FIG. 6). For both cases, measurement of a height variation ΔH and a thickness variation Δt was performed. Those results are also illustrated in FIG. 7 and FIG. 8.

Figure 7:
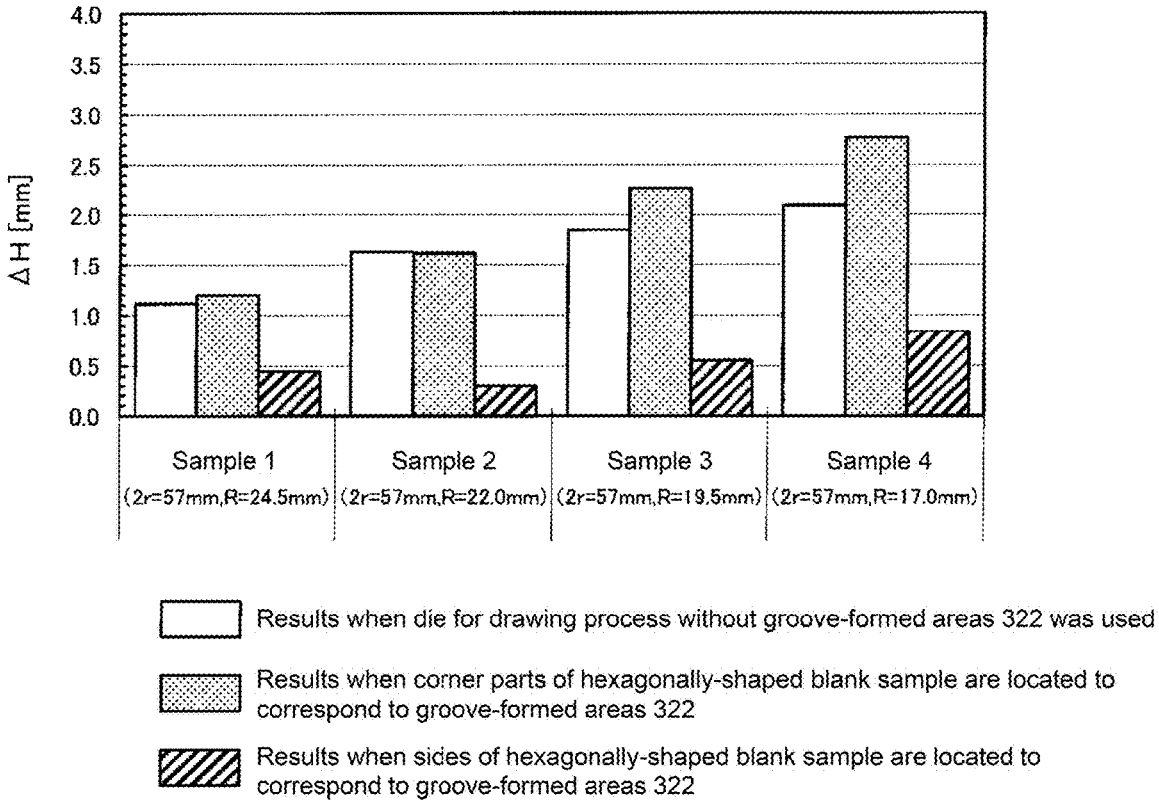
FIG. 7 is a graph illustrating measurement results of height variation ΔH in Example 1.
Figure 8:
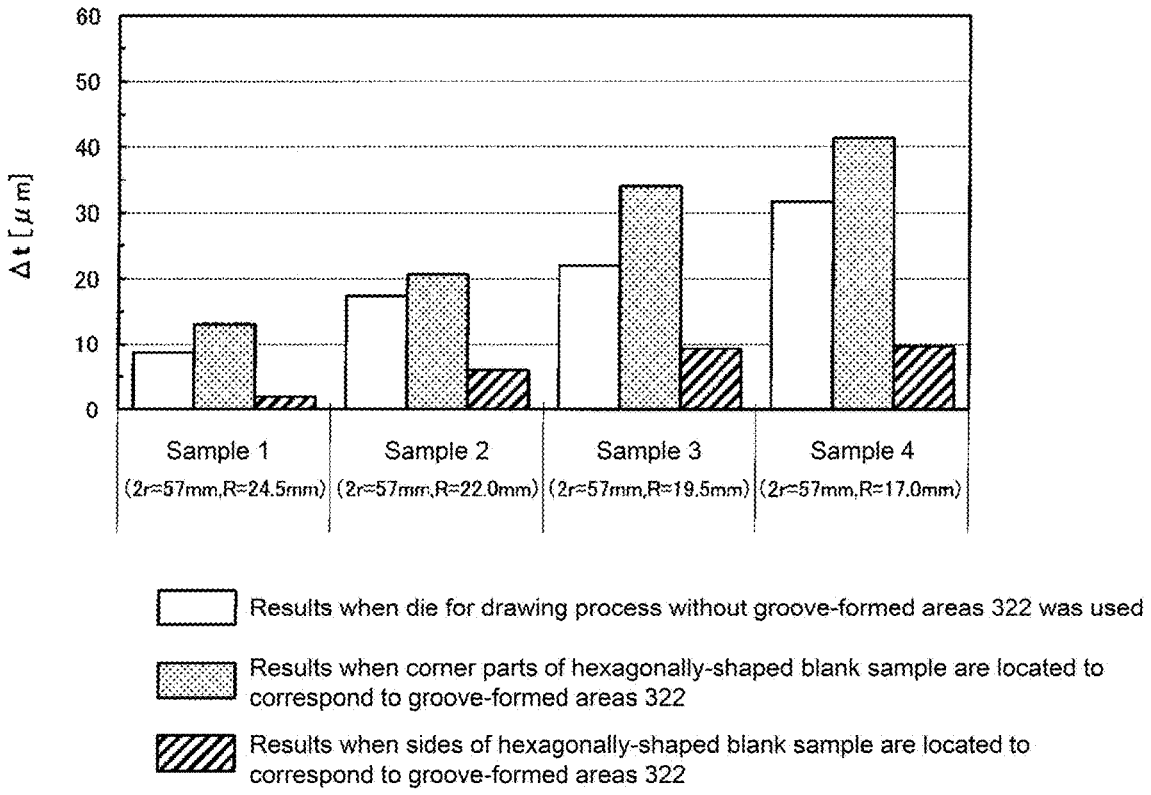
FIG. 8 is a graph illustrating measurement results of thickness variation Δt in Example 1.

As illustrated in FIG. 7 and FIG. 8, it can be confirmed that all of Blank Samples 1 to 4 have a high improvement effect on the height variation ΔH and the thickness variation Δt when the drawing process is performed in the state in which the blank sample is clamped between the die 30 and the blank holder 40 so that the sides of the hexagonal shape are located to correspond to the groove-formed areas 322 of the die 30 (i.e., in a state as illustrated in FIG. 6). On the other hand, in the case in which the blank sample is clamped between the die 30 and the blank holder 40 so that the corner parts of the hexagonal shape are located to correspond to the groove-formed areas 322 (i.e., in a state of the hexagonally-shaped blank rotated by 30° from the state as illustrated in FIG. 6), results are such that the height variation ΔH and the thickness variation Δt are large in all of Blank Samples 1 to 4 compared with the case of using a die without the groove-formed areas 322 as the die 30 for drawing process.

Comparative Example 1

The nickel plated low-carbon steel sheet of a sheet thickness of 0.25 mm used as the metal sheet 10 was substituted with a laminated steel sheet obtained by laminating a low-carbon steel sheet of a thickness of 0.22 mm with a polyester resin layer of 15 μm. A hexagonally-shaped blank as illustrated in FIG. 2 was punched out of the laminated steel sheet. In the Comparative Example 1, hexagonally-shaped Blank Sample 5 was prepared to have a diagonal line length of 2*r*=57 mm and a radius of curvature of R=17.0 mm, the curvature having a shape rounded into a circular arc and formed at a corner part.

Figure 9:
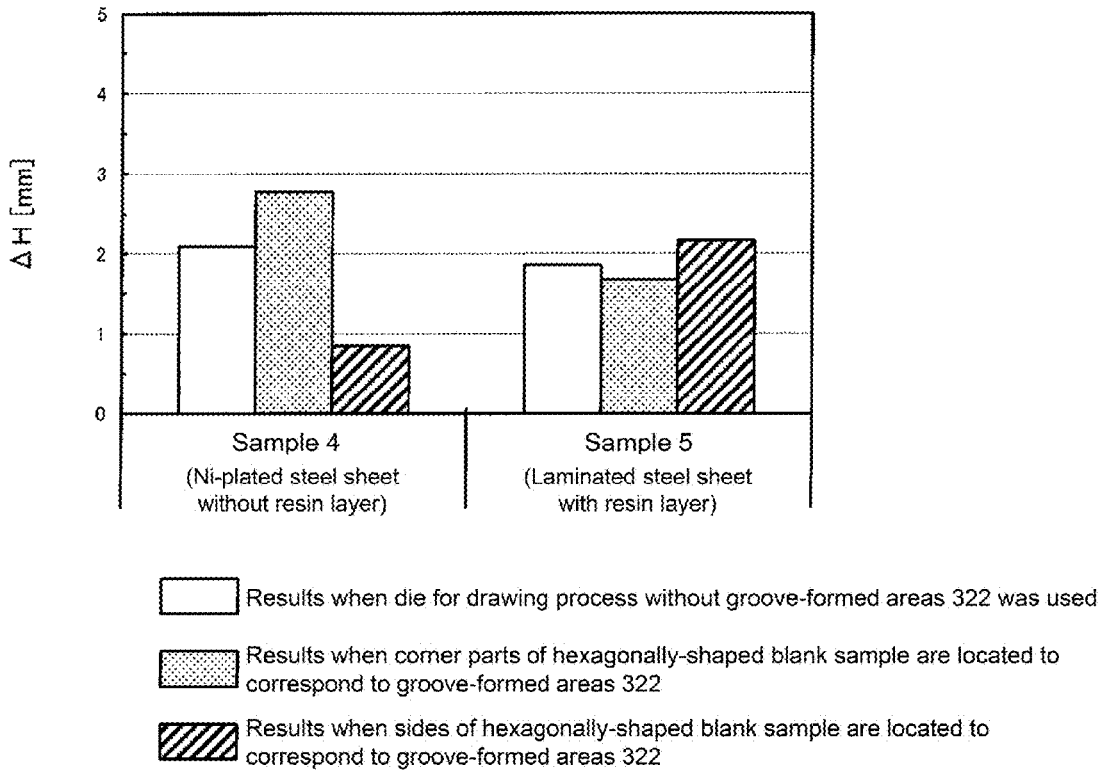
FIG. 9 is a graph illustrating measurement results of height variation ΔH in Comparative Example 1.
Figure 10:
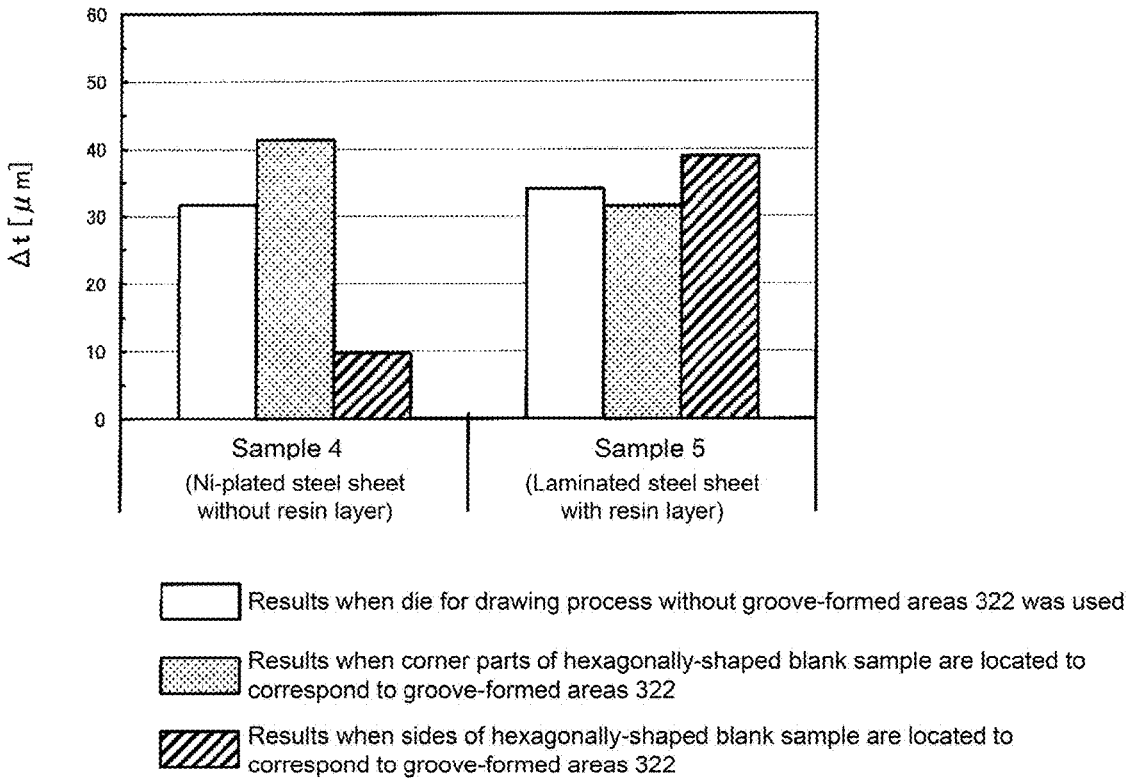
FIG. 10 is a graph illustrating measurement results of thickness variation Δt in Comparative Example 1.

The drawing process was performed using the prepared Blank Sample 5 in a similar manner to that in Example 1 except for changing the clamping force applied by the die 30 and the blank holder 40 to 15 kN, and a cylindrical container having a container height of about 18 mm was thus manufactured. Thereafter, measurement of the height variation ΔH and the thickness variation Δt was performed as with Example 1. Results are illustrated in FIG. 9 and FIG. 10. FIG. 9 and FIG. 10 also illustrate results of Sample 4 having the same diagonal line length 2*r* and the same radius of curvature R. In Comparative Example 1, if the clamping force applied by the die 30 and the blank holder 40 was 20 kN, the resin layer would be damaged. For this reason, the clamping force of 15 kN was selected to prevent such damage of the resin layer.

In addition, for comparison also in Comparative Example 1, a different drawing process was performed for Blank Sample 5 using a die without the groove-formed areas 322 as the die 30 for drawing process, and a further different process was also performed for Blank Sample 5 in a state in which Blank Sample 5 was clamped between the die 30 and the blank holder 40 so that the corner parts of the hexagonal shape of Blank Sample 5 would be located to correspond to the groove-formed areas 322 (i.e., in a state of the hexagonally-shaped blank rotated by 30° from the state as illustrated in FIG. 6). For both cases, measurement of the height variation ΔH and the thickness variation Δt was performed. Those results are also illustrated in FIG. 9 and FIG. 10.

As illustrated in FIG. 9 and FIG. 10, when the laminated steel sheet laminated with polyester resin as the resin layer is used, the height variation ΔH and the thickness variation Δt are improved to some extent in Sample 5 for which the drawing process is performed in the state in which Blank Sample 5 is clamped between the die 30 and the blank holder 40 so that the corner parts of the hexagonal shape of Blank Sample 5 are located to correspond to the groove-formed areas 322 (i.e., in a state of the hexagonally-shaped blank rotated by 30° from the state as illustrated in FIG. 6), but the degree of the improve is very low compared with Blank Sample 4 using a nickel plated steel sheet with no resin layer.

DESCRIPTION OF REFERENCE NUMERALS

10 . . . Metal sheet
20 . . . Hexagonally-shaped blank
30 . . . Die for drawing process
  32 . . . Wrinkle preventing surface
    321 . . . Smooth area
    322 . . . Groove-formed area
      322*a* . . . Grooved part
40 . . . Blank holder
50 . . . Punch

What is claimed is:

1. A method of manufacturing a cylindrical container using a metal sheet on at least one surface of which the metal is exposed, comprising:

obtaining a blank having a hexagonal shape from the metal sheet; and processing the blank into a cylindrical shape by pressing a central part of the blank with a punch in a state in which a peripheral part of the blank is clamped between a die for drawing process and a blank holder, wherein at least one of the die for drawing process and the blank holder has a plurality of groove-formed areas having a plurality of grooves which are arranged along a radial direction on a surface thereof, the plurality of groove-formed areas having the plurality of grooves being formed in an area corresponding to a plurality of sides of the blank having the hexagonal shape, wherein the blank is processed into the cylindrical shape by clamping the peripheral part of the blank between the die for drawing process and the blank holder so that the surface of the blank on which the metal is exposed is in a state of facing the plurality of groove-formed areas having the plurality of grooves and the plurality of sides of the blank is in a position that corresponds to the plurality of groove-formed areas having the plurality of grooves.

2. The method of manufacturing a cylindrical container according to claim 1, wherein the plurality of groove-formed areas having the plurality of grooves are formed along a circumferential direction and on the surface of the at least one of the die for drawing process and the blank holder, the plurality of groove-formed areas having the plurality of grooves being formed in the area corresponding to the plurality of sides of the blank having the hexagonal shape.

3. The method of manufacturing a cylindrical container according to claim 2, wherein the plurality of groove-formed areas having the plurality of grooves formed along the circumferential direction and in the area corresponding to the plurality of sides of the blank are each formed in a region of 15° to 45° with the circumferential direction.

4. The method of manufacturing a cylindrical container according to claim 1, wherein the die for drawing process has the plurality of groove-formed areas having the plurality of grooves on the surface thereof, the plurality of groove-formed areas having the plurality of grooves being formed in the area corresponding to the plurality of sides of the blank having the hexagonal shape.

* * * * *